United States Patent [19]

Hunter

[11] 4,399,683

[45] Aug. 23, 1983

[54] VEHICLE DOOR ALIGNING TOOL

[76] Inventor: Theodore K. Hunter, 6305 Buena St., Atascadero, Calif. 93422

[21] Appl. No.: 326,487

[22] Filed: Dec. 2, 1981

[51] Int. Cl.[3] ..... B21D 1/12

[52] U.S. Cl. ..... 72/458; 72/479; 72/705; 81/3 R

[58] Field of Search ..... 29/267, 271, 11; 72/458, 479, 705; 52/291; 33/180 AT; 81/3 R

[56] References Cited

U.S. PATENT DOCUMENTS

| | | | |
|---|---|---|---|
| 1,302,595 | 5/1919 | Russell | 29/267 |
| 1,814,435 | 7/1931 | De Laney | 72/705 |
| 2,689,494 | 9/1954 | Brown | 72/458 |
| 2,852,971 | 9/1958 | Macaluso, Jr. | 72/458 |
| 3,332,274 | 7/1967 | Dunster, Jr. | 72/458 |
| 3,611,784 | 10/1971 | Prichard | 72/479 |
| 3,965,720 | 6/1976 | Goodwin et al. | 72/479 |

FOREIGN PATENT DOCUMENTS

| | | | |
|---|---|---|---|
| 2041138 | 8/1979 | Fed. Rep. of Germany | 29/271 |

*Primary Examiner*—Lowell A. Larson

*Attorney, Agent, or Firm*—Boniard I. Brown

[57] ABSTRACT

Apparatus for aligning an associated vehicle door with the cooperating portions of an associated vehicle body includes a lever and structure for engaging a lock pin on the door jamb of the associated vehicle body carried on the lever at a first axial location. The structure for engaging an associated door lock of the associated door is carried on the lever at a second axial location which is spaced from the first axial location. The structure for engaging a lock pin may comprise a generally arcuate recess and the generally arcuate recess may be generally C-shaped, with opposed spaced sides, and include a notch in the arcuate recess disposed in opposed relationship to an opening between the opposed sides of the recess. The structure for engaging the lock pin may include a tongue having an arcuate recess extending along at least one side thereof.

8 Claims, 5 Drawing Figures

VEHICLE DOOR ALIGNING TOOL

BACKGROUND OF THE INVENTION

The invention relates to automobile and truck body working tools and more particularly to apparatus for aligning a vehicle door with the cooperating door opening either during initial body assembly or during subsequent body work. One approach to force a door upwardly, relative to a vehicle door frame, has been to wedge an axial section of a two inch by four inch wooden timber intermediate the bottom of the door and the rocker panel. The rocker panel is, of course, the stepped area immediately beneath the door. A force is applied to the free end of the axial section of the two by four wooden member to bend or spring the door hinge structure to produce the desired alignment. To align the door downwardly, relative to the vehicle frame structure, the conventional method has been to apply the weight of the repairman's body to the top of the open door, so as to bend or spring the hinge structure.

Such methods have not been satisfactory because the amount of displacement of the door will vary greatly from one vehicle to another. This prior art method is also unsatisfactory because chipping of the paint as well as actual deformation or other damage to the lower portion of the door is often caused by the wooden timber.

Another prior art technique utilizes a pair of cylindrical members having studs or sharp projections from the curved base, to prevent slippage. These cylindrical members are of two different sizes so that the operator may select one that will produce a more desirable result. A device of the selected size is inserted between the door and the door jamb adjacent to the hinge. The door is then closed upon the device to bend or stretch the upper or lower hinge structure. The use of this type of device involves the substantial hazard of bending the hinges too much with resultant incorrect alignment. Apparatus of this type also involves the substantial hazard of positioning in laterally outwardly spaced relation to the door frame which condition requires substantial work to correct.

The large variety of automobile structures presents difficulties in attempting to provide suitable apparatus, it being very difficult to provide apparatus which will cooperate with such varied structures.

It is an object of the invention to provide apparatus which simplifies and makes more precise the task of aligning a vehicle door, and which reduces the likelihood of improper adjustment which would be even harder to correct than the original misalignment.

It is another object of the invention to provide apparatus which allows application of an easily varied force so that a progressively greater force may be applied to produce just the required physical correction.

It is another object of the invention to provide apparatus which avoids scraping of any paint or any deformaton of any body structure.

Another object of the invention is to provide apparatus which attains these objectives without any lateral bending of the hinges which would tend to position the door in spaced relationship from the primary body structure.

Another object of the invention is to provide structure which will cooperate with a wide variety of automobile structures.

SUMMARY OF THE INVENTION

The foreging objects and other objects and advantages which shall become apparent from the detailed description of the preferred embodiment are attained in an apparatus for aligning an associated vehicle door with the cooperating portions of an associated vehicle body which includes a lever having means for engaging a lock pin on the door jamb of the associated vehicle body which is carried on the lever at a first axial location and means for engaging an associated door lock of the associated door carried on the lever at a second axial location which is spaced from the first axial location.

In some forms the means for engaging a lock pin may comprise a generally arcuate recess and the generally arcuate recess may be generally C-shaped, with opposed spaced sides, and include a notch in the arcuate recess disposed in opposed relationship to an opening between the opposed sides of the recess.

The means for engaging the lock pin may include a tongue having an arcuate recess extending along at least one side thereof. The tongue may have arcuate recesses on each side and the recesses may extend inwardly towards the geometric center line of the tongue. The means for engaging the associated door lock may include a shoulder member. The shoulder member may be a shoulder screw and the apparatus may include a plurality of shoulder screws of varying sizes to cooperate with door locks of varying sizes.

The first axial location may be disposed at a first axial extremity of the lever and the apparatus may be generally rectilinear intermediate the first and second axial locations. The lever may be bowed intermediate the second axial location and a second axial extremity.

BRIEF DESCRIPTION OF THE ACCOMPANYING DRAWING

DESCRIPTION OF THE PREFERRED EMBODIMENT

Figure 3:
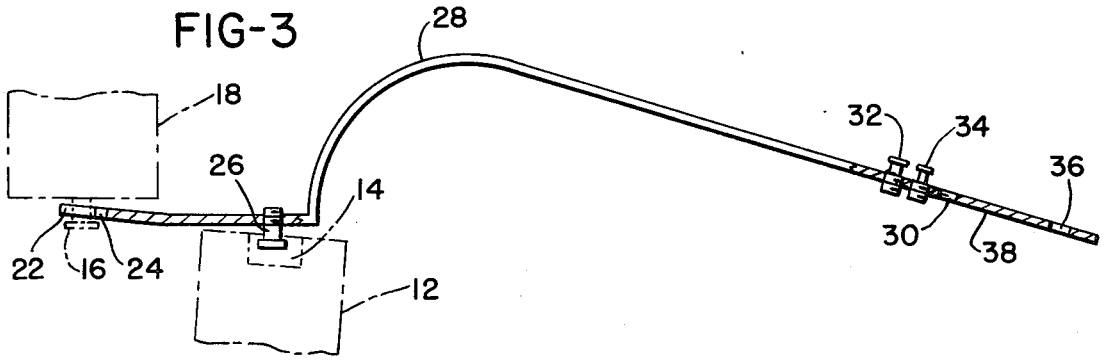
FIG. 3 is a plan view, in partial section, of a portion of the tool illustrated in FIGS. 1 and 2, and which illustrates the geometric relationship with the cooperating lock pin and door lock in greater detail.

Referring now to FIGS. 1–4, there is shown an automobile 10 having a door 12 which is aligned to the body of the automobile 10. As best seen in FIG. 3, the door 12 includes a door lock or latch 14 which cooperates with a lock pin 16 which extends generally horizontally from a generally vertical lock pillar 18. The construction of various doors will vary widely. Although the invention has primary application to door assemblies manufactured since 1964, it will be understood to have application to a wide variety of such assemblies. In general, the door assemblies manufactured since 1964 do utilize a fixed "catch" pin mounted on the door pillar and a door lock assembly mounted in the door.

The tool 20, in accordance with the invention, is a lever. Disposed at a first axial extremity is an arcuate recess 22 which cooperates with the lock pin 16. The arcuate recess 22 may also include a notch 24 to increase the variety of lock pins which may be engaged by the apparatus. Spaced axially along the tool 20 from the first axial extremity is a means 26 for engaging the door lock 14 on the edge of the door 12. The means 26, in the preferred embodiment, is a ½ inch shoulder screw. A shoulder screw is, of course, a screw with an unthreaded cylindrical section, or shoulder, between threads and a screw head. The shoulder screw 26 is disposed in a threaded bore in the tool 20. The shoulder is larger in diameter than the threaded section and provides a surface around which close fitting moving parts operate. In this case the close fitting parts are the parts of a door lock.

Spaced still further from the means 22 for engaging the lock pin 16 is an arcuate section 28 of the tool 20 which is intended to avoid any possibility of contact with the paint or sheet metal of the body of the automobile 10. Still further toward the second or other axial extremity of the tool 20 are a plurality of threaded bores, such as 30, in which shoulder screws of various sizes may be disposed. Thus the user may replace the ½ inch shoulder screw 26 with a ¼ inch shoulder screw 32 or a ⅜ inch shoulder screw 34 merely by unscrewing the appropriate members and moving them from one location to another. Although obviously not essential to the invention, the shoulder screws are all 5/16-18 NC threads. Disposed proximate to the second axial extremity of the tool 20 is a hole 36 which enables the user to hang the apparatus when it is not in use.

Figure 1:
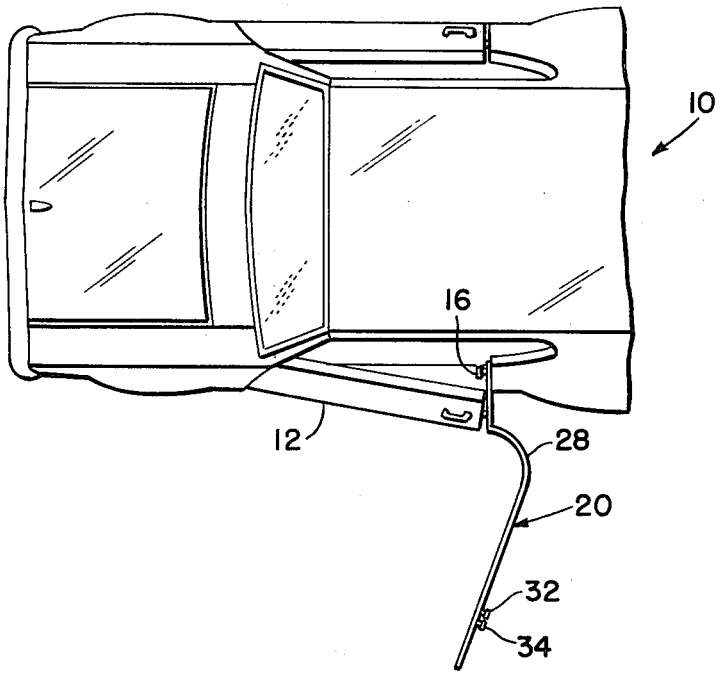
FIG. 1 is a plan view of the front portion of an automoble on which the apparatus in accordance with the invention is being used to align the left hand door.
Figure 2:
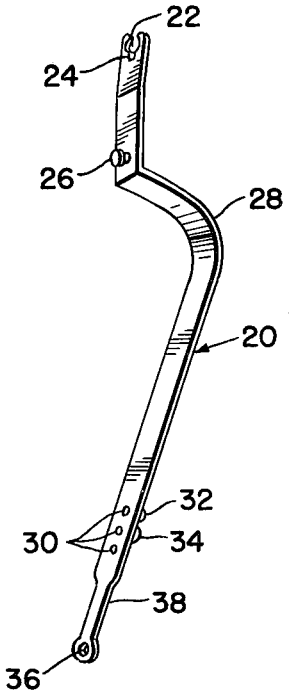
FIG. 2 is a perspective view of the door alignment tool illustrated in FIG. 1.

In operation, the user grasps the handle 38 and engages the lock pin and door lock, as shown in FIGS. 1 and 3, and pries either upward or downward depending upon the direction of the desired adjustment. Because the tool 20 allows great mechanical advantage compared to a force applied by more conventional methods, the user is able to progressively apply increasing forces until the proper alignment of the door and the rest of the body is achieved. The end of the tool 20, including the means 22 for engaging the lock pin 16 and the means 26 for engaging the door lock 14, will ordinarily be coated with a heavy plastic coating so as to prevent scratching or marring of the paint on the surfaces against which the tool may be brought in contact. In some forms of the invention, the entire tool may be covered with plastic to still further reduce the probability of damaging the finish of the vehicle on which the tool is to be used.

Figure 4:
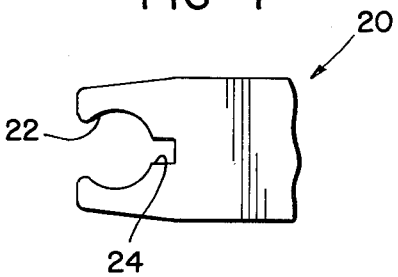
FIG. 4 is an elevational view of a portion of the apparatus illustrated in FIGS. 1, 2 and 3.
Figure 5:
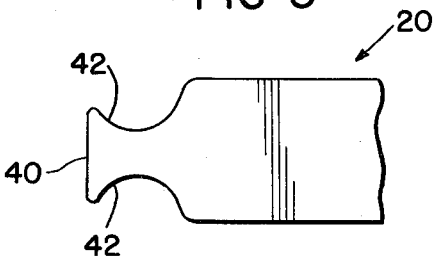
FIG. 5 is an elevatonal view of a portion of a structure which is an alternative to the structure illustrated in FIG. 4.

In FIG. 5 there is shown a structure which is an alternative to that illustrated in FIG. 4. More specifically, the means 22 for engaging the lock pin 16 may include a tongue shaped member 40 having arcuate recesses 42 on opposed sides thereof which extend inwardly toward the center line of the tongue 40. In use, the operator will position the arcuate recess 42 against the locking pin 16 to achieve the desired result. The manner of engagement with the door lock and lock pin ensures that there will be no damage to the paint or deformation of the sheet metal in the area of the door. The apparatus also is simple and efficient and may be effectively utilized even by unskilled workers to provide desired bending of the hinge structure without undesired lateral bending of the hinge.

The invention has been described with reference to its illustrated preferred embodiment. Persons skilled in the art may, upon exposure to the teachings herein, conceive variations in the mechanical development of the components therein. Such variations are deemed to be encompassed by the disclosure, the invention being delimited only by the appended claims.

The inventor claims:

1. Apparatus for aligning an associated vehicle door with the cooperating portions of an associated vehicle body which comprises:

a lever, means carried at a first axial location on said lever for engaging a lock pin on the door jamb of the associated vehicle body, and means carried on said lever at a second axial location spaced from said first axial location for engaging an associated door lock of the associated door.

2. Apparatus for aligning an associated vehicle door with the cooperating portions of an associated vehicle body which comprises:

a lever, means carried at a first axial location on said lever for engaging a lock pin on the door jamb of the associated vehicle body, and said means for engaging a lock pin comprising a generally arcuate recess, and means carried on said lever at a second axial location spaced from said first axial location for engaging an associated door lock of the associated door.

3. Apparatus for aligning an associated vehicle door with the cooperating portions of an associated vehicle body which comprises:

a lever, means carried at a first axial location on said lever for engaging a lock pin on the door jamb of the associated vehicle body, and said means for engaging said lock pin comprising a generally C-shaped arcuate recess with opposed spaced sides and a notch in said arcuate recess disposed in opposed relationship to an opening between said opposed sides of said recess, and means carried on said lever at a second axial location spaced from said first axial location for engaging an associated door lock of the associated door.

4. Apparatus for aligning an associated vehicle door with the cooperating portions of an associated vehicle body which comprises:

a lever, means carried at a first axial location on said lever for engaging a lock pin on the door jamb of the associated vehicle body, and said means for engaging said lock pin including a tongue having an arcuate recess extending along at least one side thereof, and means carried on said lever at a second axial location spaced from said first axial location for engaging an associated door lock of the associated door.

5. Apparatus for aligning an associated vehicle door with the cooperating portions of an associated vehicle body which comprises:

a lever, means carried at a first axial location on said lever for engaging a lock pin on the door jamb of the associated vehicle body, and said means for engaging said lock pin including a tongue having arcuate recesses on each side extending inwardly towards the geometric centerline of said tongue, and means carried on said lever at a second axial location spaced from said first axial location for engaging an associated door lock of the associated door.

6. The apparatus according to claims 1, 2, 3, 4 or 5, wherein:

said means for engaging the associated door lock includes a shoulder member.

7. The apparatus according to claims 1, 2, 3, 4 or 5, and further including:

a plurality of shoulder screws of varying sizes.

8. The apparatus according to claims 1, 2, 3, 4 or 5, wherein:

said first axial location is at a first axial extremity, and said apparatus is generally rectilinear intermediate said first and second axial locations and is bowed intermediate said second axial location and a second axial extremity.

* * * * *